US009303404B2

(12) United States Patent
Naito et al.

(10) Patent No.: US 9,303,404 B2
(45) Date of Patent: Apr. 5, 2016

(54) INSULATED STRUCTURAL PANEL CONNECTOR

(71) Applicant: Lehigh University, Bethlehem, PA (US)

(72) Inventors: Clay Naito, Coopersburg, PA (US); Patrick Trasborg, New York, NY (US)

(73) Assignee: LEHIGH UNIVERSITY

( * ) Notice: Subject to any disclaimer, the term of this patent is extended or adjusted under 35 U.S.C. 154(b) by 0 days.

(21) Appl. No.: 14/794,990

(22) Filed: Jul. 9, 2015

(65) Prior Publication Data

US 2016/0010330 A1 Jan. 14, 2016

Related U.S. Application Data

(60) Provisional application No. 62/022,397, filed on Jul. 9, 2014.

(51) Int. Cl.
*E04C 2/288* (2006.01)
*E04B 1/76* (2006.01)
(Continued)

(52) U.S. Cl.
CPC ..... *E04C 2/2885* (2013.01); *E04B 1/76* (2013.01); *E04C 2/044* (2013.01); *E04C 2/46* (2013.01); *E04B 2103/02* (2013.01); *E04C 2002/046* (2013.01)

(58) Field of Classification Search
CPC ..... E04C 2/044; E04C 2/088; E04C 2/228; E04C 2/2885; E04C 2/46; E04C 2002/045; E04C 2002/046; E04B 1/4178; E04B 1/4192
USPC ..... 52/309.11, 309.12, 426, 562, 568, 414, 52/378
See application file for complete search history.

(56) References Cited

U.S. PATENT DOCUMENTS 4,117,639 A * 10/1978 Steenson ..... E04C 2/044 52/223.6
4,283,896 A * 8/1981 Fricker ..... E04C 2/044 523/309.11

(Continued)

FOREIGN PATENT DOCUMENTS

DE 102005062407 7/2007

OTHER PUBLICATIONS http://www.hkties.com/products/hk-composite-action-system/, accessed Jun. 25, 2015.

(Continued)

*Primary Examiner* — Robert Canfield
(74) *Attorney, Agent, or Firm* — The Belles Group, P.C.

(57) ABSTRACT

An insulated composite structural panel comprises a first concrete layer, a second concrete layer, and an insulation layer disposed therebetween. One or more shear ties are embedded in the panel. The shear ties include a base portion and a plurality of elongated anchor elements extending from the base portion. A portion of each anchor element extends through the first and second concrete layers and insulation layer. The tie is formed of a material exhibiting ductile elastic-plastic behavior under an applied shear load. In a non-limiting example, the tie may be formed of a fiber reinforced polymer. The tie is constructed and acts to form stable flexural hinges at the interface between the insulation layer and each concrete layer. During a shear load event, portions of the anchor elements within the insulation laterally deform in a ductile manner to keep the structural panel relatively intact.

20 Claims, 11 Drawing Sheets

(51) Int. Cl.
*E04C 2/04* (2006.01)
*E04B 2/00* (2006.01)

(56) References Cited

U.S. PATENT DOCUMENTS

| | | | | | |
|---|---|---|---|---|---|
| 4,329,821 | A | | 5/1982 | Long et al. | |
| 4,624,089 | A | * | 11/1986 | Dunker | E04B 2/30 52/309.11 |
| 4,829,733 | A | | 5/1989 | Long | |
| 5,440,845 | A | * | 8/1995 | Tadros | E04C 2/044 52/309.12 |
| 5,519,973 | A | * | 5/1996 | Keith | B28B 19/003 411/439 |
| 5,606,832 | A | * | 3/1997 | Keith | B28B 19/003 411/439 |
| 5,671,574 | A | | 9/1997 | Long | |
| 5,673,525 | A | * | 10/1997 | Keith | B28B 19/003 411/487 |
| 5,809,723 | A | | 9/1998 | Keith et al. | |
| 5,830,399 | A | * | 11/1998 | Keith | B28B 19/003 264/253 |
| 5,896,714 | A | | 4/1999 | Cymbala et al. | |
| 6,088,985 | A | * | 7/2000 | Clark | E04C 2/044 52/309.11 |
| 6,378,260 | B1 | | 4/2002 | Williamson et al. | |
| 6,761,007 | B2 | * | 7/2004 | Lancelot, III | E04C 2/044 52/309.7 |
| 6,820,384 | B1 | | 11/2004 | Pfeiffer | |
| D617,009 | S | | 6/2010 | Lemings et al. | |
| 8,312,683 | B2 | * | 11/2012 | Tadros et al. | E04C 2/044 52/309.11 |
| 8,397,455 | B2 | | 3/2013 | Devalapura | |
| 2002/0124508 | A1 | | 9/2002 | Dunn et al. | |
| 2003/0208987 | A1 | | 11/2003 | Lancelot, III et al. | |
| 2004/0074182 | A1 | * | 4/2004 | Andros | F16B 15/06 52/309.12 |
| 2004/0118067 | A1 | | 6/2004 | Keith | |
| 2006/0032166 | A1 | * | 2/2006 | Devalapura | B32B 3/30 52/309.15 |
| 2007/0294970 | A1 | | 12/2007 | Marshall et al. | |
| 2008/0155919 | A1 | * | 7/2008 | Keshishian | E04C 2/044 52/309.11 |
| 2009/0013631 | A1 | | 1/2009 | Devalapura | |
| 2013/0326980 | A1 | | 12/2013 | Hilliard, Sr. | |
| 2014/0144102 | A1 | * | 5/2014 | Chen | E04C 2/044 52/782.1 |
| 2015/0167303 | A1 | * | 6/2015 | Foderberg | E04C 5/162 29/897.32 |

OTHER PUBLICATIONS

HK CA Ties for Tiltup & Precast Insulated Concrete Panels, Installation Instructions, HK Composites, Apr. 2014.

CC Series, Thermomass, www.thermomass.com, accessed Jun. 25, 2015.

* cited by examiner

INSULATED STRUCTURAL PANEL CONNECTOR

CROSS-REFERENCE TO RELATED APPLICATIONS

The present application claims the benefit of priority to U.S. Provisional Application No. 62/022,397 filed Jul. 9, 2014, the entirety of which is incorporated herein by reference.

STATEMENT OF GOVERNMENT INTEREST

This invention was made with government support under CMMI-1030812 awarded by The National Science Foundation (NSF). The government has certain rights in the invention.

BACKGROUND

The present invention generally relates to insulated concrete wall panels, and more particularly to shear ties or connectors for such panels.

"Leadership in Energy and Environmental Design" (LEED) certified, environmentally-friendly construction has become standard practice in the United States. Building owners are willing to pay a premium overhead cost in order to save on life-cycle costs and receive additional financial benefits from the government by meeting LEED standards. To minimize operational costs and obtain LEED certification, building cladding systems must be thermally efficient. The precast concrete industry responded to consumer needs by developing the insulated precast wall panel, a building envelope comprised of a layer of insulating foam, typically expanded or extruded polystyrene, sandwiched between an external and internal layer (wythe) of concrete as shown in FIG. 1. If a solid concrete panel was fabricated with the same thickness as an insulated panel, the solid concrete wall would be over 50 times less thermally efficient than the insulated wall panel due to the high conductivity of concrete.

Intuitively by replacing concrete with foam reduces the strength of the wall panel. By removing the interior concrete, the mechanism to transfer the required interface shear is no longer present thus reducing the out-of-plane flexural strength of the panel. In order for insulated wall panels to have the same strength as a solid concrete wall panel, the interior and exterior concrete wythes must act in unison (compositely) to resist applied loads. The term "composite behavior" is a term of art referring to the ability of the insulated wall panel to behave under load as a single unitary structure. Historically, to achieve composite behavior strong metal devices (shear ties) physically connected the exterior and interior concrete wythes as shown in FIG. 1. The devices were able to transfer some horizontal shear to increase the strength of the panel; however, by physically connecting the two wythes with highly conductive metal devices, thermal bridging occurs creating "hot-spots" that had a detrimental effect on the thermal resistance of the entire panel. Additionally, localized hot-spots cause excessive condensation which can cause mold.

Today, several proprietary shear tie systems exist that utilize thermally resistive material to mitigate thermal bridging and condensation effects. However, tie systems available on the market today may lack the strength required to economically reach composite action, lack deformation capacity, allow concrete to pass along the tie creating a thermal bridge, or are subject to large installation tolerances creating a high variance in the actual panel strength.

Although insulated panels are designed utilizing shear ties to meet a prescribed demand and thermal resistance, they often suffer from quality control problems during fabrication. For shear ties to reach the capacity for which they are designed, they must be placed at specific locations and with defined embedment otherwise the capacity of the ties may be controlled by the strength of the concrete, due to pull-out or pry-out failure mechanisms, rather than the strength of the tie. Additionally, in poorly executed installations concrete may bleed past the shear tie creating a large thermal bridge reducing the overall panel thermal resistance. To ensure proper installation, extra effort must be taken by the fabricator during shear tie placement translating to a longer production time and additional expense.

Finally, shear ties currently available are designed to withstand conventional life cycle loads such as lifting during construction and wind loads during service; however, no shear ties exist which account for extreme events such as a blast load. Most government facilities mandate both energy and security requirements. An ideal solution to both requirements is a precast insulated wall panel with shear ties designed for high explosive detonations. In blast design, the primary mode of energy dissipation is panel deformation. By designing a shear tie with a large amount of ductility, the wall panel can displace more energy generated during a detonation before failing reducing the risk to inhabiting occupants.

An improved shear tie for a concrete wall panel is desired.

SUMMARY

A new shear tie system is provided that is strong enough to allow an insulated concrete composite panel to reach the nominal moment capacity, highly deformable, prevent concrete passage, and designed to reduce installation tolerances. Additionally, by creating a deformable shear tie the maximum attainable panel deflection is increased, creating an additional market for blast and impact applications where energy dissipation through panel deflection is required.

The shear tie was developed based on first principles, ACI 318-11 code requirements, finite element analysis (FEA), and ergonomics. The shear tie is further designed to fit comfortably in the hand for ease of installation during concrete panel formation and fabricated from a high performance thermally resistive fiberglass composite. In one non-limiting implementation, the shear tie is made of glass fiber reinforced polymer (GFRP) such as without limitation a thermoset polyester resin with a unidirectional fiber orientation, as further described herein.

The comb shape of the shear tie with pointed ends was selected to allow easy penetration through the insulation layer during panel formation. The ergonomic design allows for quick installation allowing a single worker to install more ties in the same amount of time. Additionally, the comb shape automatically forces the tie to stop once the base of the comb with installers fingers between the elongated tines or anchor elements of the tie reaches the insulation panel thereby ensuring correct and consistent installation every time. This also ensures that a top portion of the open slots between the anchor elements s remain between the base of the tie and the insulation panel which is later filled with concrete during the final wythe pour to further interlock the tie with the final wythe.

According to an aspect of the invention, an insulated composite structural wall panel includes: a first concrete layer; a second concrete layer; an insulation layer disposed between the first and second concrete layers; a shear tie embedded in the wall panel and connecting the first concrete layer to the second concrete layer, the shear tie having a longitudinal axis, a base portion, and a plurality of longitudinally elongated anchor elements extending therefrom, the shear tie constructed of a non-metallic material that exhibits an elastic-plastic response to an applied shear load; each of the anchor elements having a length, an upper portion disposed in the first concrete layer, a lower portion defining a terminal distal end disposed in the second concrete layer, and an intermediate portion disposed in the insulation layer; a first flexural hinge formed in each anchor element at a first interface between the first concrete layer and the insulation layer; wherein when a transverse shear load is applied to the anchor elements by lateral movement of the first or second concrete layers, the intermediate portion of each anchor element is transversely and angularly deformed in an elastic-plastic manner about the first flexural hinge at the concrete to insulation layer interfaces. In one implementation, the shear tie is formed of a unidirectional fiber reinforced polymer matrix; the fibers in each anchor element running in a direction along the length of each anchor element. In certain implementations, a second flexural hinge is formed in each anchor element at a second interface between the second concrete layer and the insulation layer, wherein each anchor element is transversely and angularly deformed in an elastic-plastic manner about the first and second flexural hinges within the insulation layer when a transverse shear load is applied to the anchor elements.

According to another aspect, an insulated composite structural wall panel includes: a first concrete layer; a second concrete layer; an insulation layer disposed between the first and second concrete layers; a shear tie comprising a longitudinal axis, a front surface having a flat profile, and a rear surface having a flat profile and parallel to the front surface, the shear tie formed of a fiber reinforced polymer material characterized by an elastic-plastic response to an applied shear load; a base portion defined by the shear tie and extending transversely to the longitudinal axis; a plurality of elongated anchor elements extending from the base portion parallel to the longitudinal axis, each anchor element having a rectilinear cross-section, a length, opposing lateral sides, a proximal end at the base portion, an opposite distal end, and an axial centerline, the anchor elements spaced laterally apart by elongated through-slots formed between the anchor elements that extend for the entire length of the anchor elements; each of the anchor elements having an upper portion embedded in the first concrete layer, a lower portion embedded in the second concrete layer, and an intermediate portion disposed in the insulation layer; wherein after a transverse shear load is applied to the first or second concrete layer, the intermediate portion of each anchor element within the insulation layer is deformed in a ductile elastic-plastic manner and laterally displaced such that the axial centerlines of the upper and lower portions are laterally offset from each other. In one implementation, the fiber reinforced polymer comprises unidirectional fibers in each anchor element running in a direction parallel to the longitudinal axis along the length of each anchor element.

A method for sustaining an applied shear force in a composite structural panel is provided. The method includes: providing the composite structural panel including a first concrete layer, a second concrete layer, and an insulation layer disposed therebetween; providing a shear tie connecting the first concrete layer to the second concrete layer, the shear tie having a longitudinal axis, a base portion embedded in the first concrete layer, and a plurality of longitudinally elongated anchor elements connected to the base portion, each anchor element having an upper portion embedded in the second concrete layer, a lower portion defining a terminal distal end embedded in the first concrete layer, and an intermediate portion disposed in the insulation layer and oriented parallel to the longitudinal axis of the shear tie; the anchor elements of the shear tie constructed of a non-metallic material that exhibits an elastic-plastic response and failure mode to an applied shear load; laterally translating the first or second concrete layer in a first lateral direction transverse to the longitudinal axis of the shear tie, wherein a shear load is applied to the intermediate portion of each anchor element; deforming the intermediate portion of each anchor element in an elastic-plastic manner in response to translating the first or second concrete layer; and laterally deflecting the intermediate portion of each anchor element in the first lateral direction; wherein the intermediate portions of each anchor element in the insulation layer are oriented obliquely to the longitudinal axis of the shear tie. In one implementation, the shear tie is formed of a unidirectional fiber reinforced polymer matrix; the fibers in each anchor element running in a direction along the length of each anchor element.

Further areas of applicability of the present invention will become apparent from the detailed description provided hereinafter.

BRIEF DESCRIPTION OF THE DRAWINGS

The features of the exemplary embodiments will be described with reference to the following drawings where like elements are labeled similarly, and in which.

Figure 1:
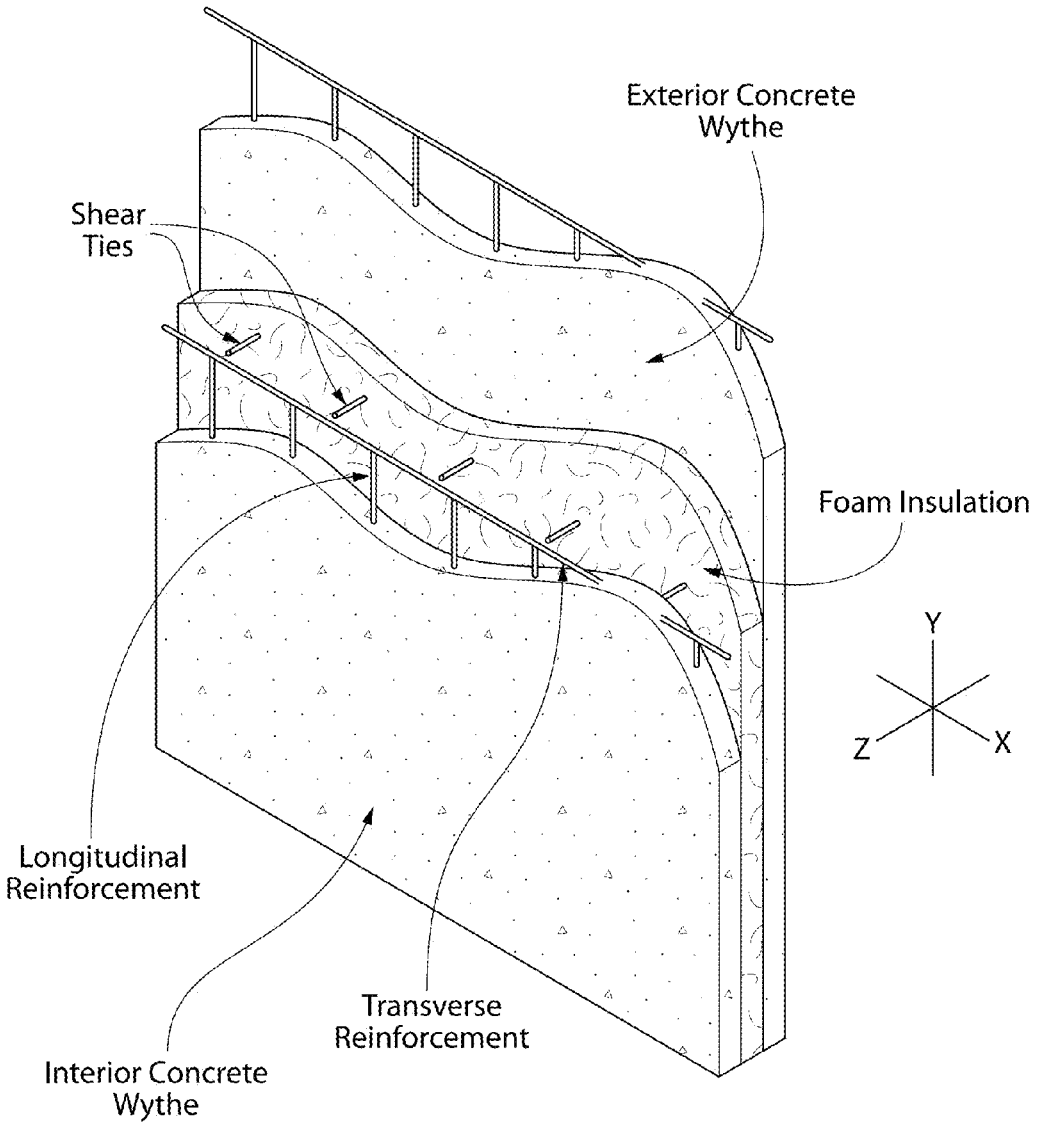
FIG. 1 (PRIOR ART)
FIG. 1 is a perspective view of a known insulated composite structural wall panel.
Figure 3:
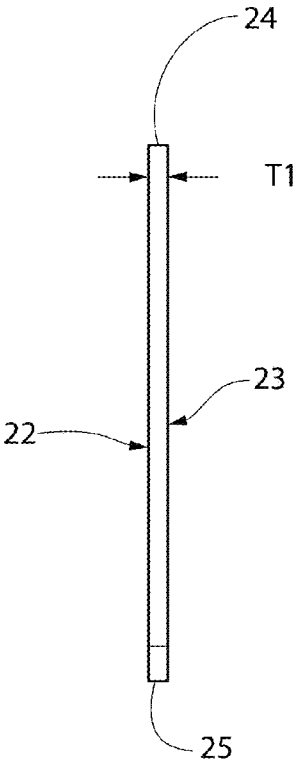
FIG. 3 is a side view thereof.

All drawings are schematic and not necessarily to scale. Parts given a reference numerical designation in one figure may be considered to be the same parts where they appear in other figures without a numerical designation for brevity unless specifically labeled with a different part number and/or described herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

FIGS. 2-5 depict a non-limiting exemplary embodiment of an improved shear tie 20 for insulated concrete composite structural wall panel construction. Shear tie 20 in this implementation has a substantially flat body comprising a laterally-elongated common base portion 21, a pair of spaced part peripheral exterior anchor elements 30 that define lateral sidewalls of the tie, a plurality of spaced apart interior anchor elements 31 arranged between the exterior anchor elements, a front surface 22, a rear surface 23, a top end 24, and a bottom end 25. The base portion 21 extends and forms a bridge laterally between the exterior anchor elements 30 to support all of the anchor elements 30, 31. The anchor elements may be considered to have a finger-like or leg-like shape. Anchor elements 30, 31 extend in a single axial direction along longitudinal axis LA from base portion 21. The anchor elements each have an upper portion 34, a lower portion 39, and intermediate portion 35 between the upper and lower portions.

In one embodiment, the front surface 22 of the shear tie 20 is parallel to the rear surface 23. Both surfaces 22, 23 may be substantially flat or planar; however, other surface profiles including non-planar are possible for one or both surfaces 22, 23.

Anchor elements 30 and 31 each have a longitudinal length L1 defining an axial CL coinciding with the geometric centerline along the length of each element. Base portion 21 has a lateral or transverse length L2 defining a transverse axis TA perpendicular to a longitudinal axis LA of the shear tie 20. The longitudinal axis LA is oriented parallel to the anchor centerlines CL of the anchor elements 30, 31 and passes through the geometric centerline of the shear tie. In the illustrated embodiment, shear tie 20 has a symmetrical shape about the longitudinal axis LA. In other possible configurations, the shear tie may have an asymmetric shape.

Exterior and interior anchor elements 30, 31 are longitudinally elongated and may have the same length L1 in one embodiment. Anchor elements 30, 31 are each connected to and arranged perpendicular to the common base portion 21 such that the anchor centerlines CL are oriented perpendicular to the transverse axis TA of the base portion. This configuration represents the undeformed pre-shear undeformed condition of the shear tie 20 shown in FIG. 4. In this condition, the anchor elements 30, 31 are oriented parallel to each other and the longitudinal axis LA.

With continuing reference to FIGS. 2-5, each of the anchor elements 30, 31 has opposing longitudinally-extending lateral sides 32. The lateral sides 32 extend between the front and rear surface 22, 23 of each anchor element. Lateral sides 32 may be substantially straight and arranged parallel to each other on each anchor element 30, 31 as shown for at least a majority of the length of the anchor elements, and preferably through the entire insulation layer as further described herein. In one embodiment, an angled transition section 33 may optionally be formed in the lateral sides 32 proximate to the base portion 21. Transition section 33 is obliquely angled at an angle A1 to the axial centerline CL and lateral sides 32 of the anchor elements, as well as the longitudinal axis LA of the shear tie as shown. The upper portion 34 on each anchor element 30, 31 where each element transitions into the base portion 21 has a larger cross-section and corresponding transverse width (measured along the transverse axis TA) than the narrower middle portion 35 below which resides in the insulation layer (see, e.g. FIGS. 4 and 6). These enlarged upper portions 34 structurally reinforce the part of the anchor elements 30, 31 at the locations adjoining the base portion 21. It will be appreciated that in other possible embodiments, however, the upper and intermediate portions 34, 35 of each anchor element 30, 31 may have the same cross-section and transverse width such that the lateral sides 32 of each element is parallel for their entire lengths L1.

The top proximal ends 36 of each exterior and interior anchor element 30, 31 terminate at the base portion 21. In a preferred embodiment, the bottom terminal distal ends 37 of each anchor element 30, 31 may terminate in a point 38 to facilitate insertion of the anchor elements into the unhardened concrete layer first cast and through insulation panel thereon during panel fabrication. The converging lateral sides 32 on each anchor element 30, 31 which form the point 38 are restricted to the distal portion of the anchor elements proximate to the distal end 37 in present embodiment (see, e.g. FIG. 4), and therefore do not extend for either half or a majority of the length L1 of each anchor element. The portions of the anchor elements 30, 31 embedded in the insulation layer 53 has a full transverse width and cross section. Otherwise, this may weaken the intermediate portion 35 of the anchor elements 30, 31 in the insulation which would be detrimental to achieving the desired ductile elastic-plastic response and deformation under an applied shear load, as further described herein.

Figure 4:
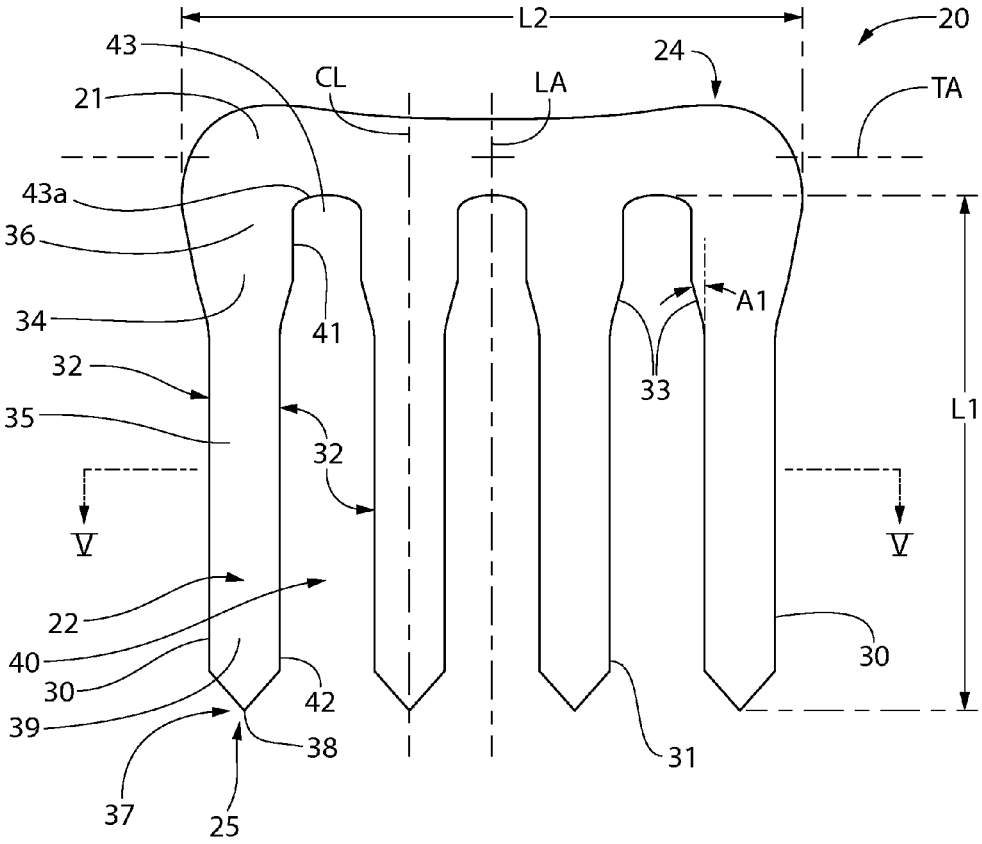
FIG. 4 is a front view thereof.
Figure 5:
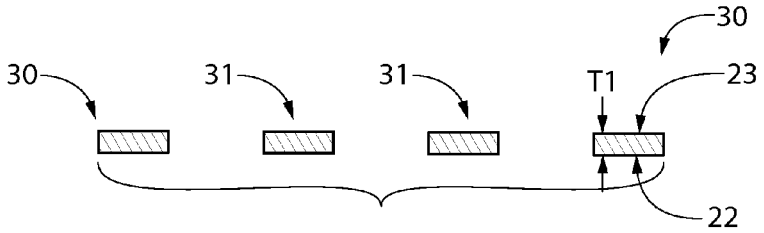
FIG. 5 is a cross-sectional view thereof taken along lines V-V in FIG. 4.

Referring to FIGS. 2-5, the shear tie 20 may have a uniform thickness T1 measured between the front and rear surfaces 22, 23 of the tie in one non-limiting implementation (see particularly FIG. 5). Accordingly, the base portion 21 and exterior/interior anchor elements 30, 31 may have the same thickness T1. Advantageously, this allows the shear ties 20 to be easily and economically cut from a single flat sheet of suitable material without machining operations due to the uniform and planar front and rear surfaces of the entire shear tie. Various means may be used to cut the anchor elements from bulk sheet of shear tie material, such a waterjet, laser, or others depending on the material selected and fabrication cost considerations. In some configurations, the anchor elements 30, 31 may have a rectilinear cross-sectional shape. In the illustrated preferred embodiment, the anchor elements have a rectangular cross-sectional shape with unequal sides wherein the lateral width of the anchor elements (measured parallel to the transverse axis) is larger than the thickness T1 of the elements. In other possible embodiments, the cross-sectional shape be square, or have other polygonal and non-polygonal shapes. In other possible constructions, the shear ties may be formed by a casting process such as injection molding.

Figure 2:
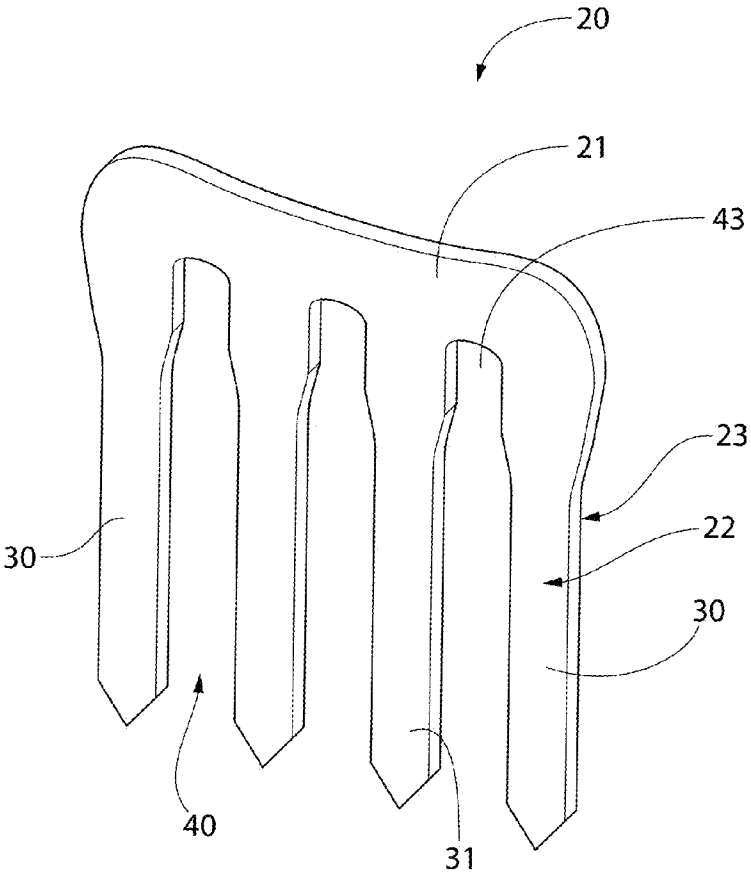
FIG. 2 is perspective view of a shear tie according to the present disclosure useable in a composite structural wall panel.

A plurality of longitudinally-extending open through-slots 40 are formed between the exterior and interior anchor elements 30, 31 as shown in FIGS. 2 and 4. Through-slots 40 extend for the entire length L1 of the anchor elements and have an open bottom portion 42 distal from the base portion 21 and a closed top portion 41 proximate to the base portion. The top portion 41 may have a narrower transverse width than the wider bottom portion 42 of each through-slot 40 in the illustrated embodiment. In one implementation, the top portion 41 may have a lateral or transverse width sufficient to allow an installer to place their fingers through a top opening 43 of each through-slot 40. This facilitates grasping and inserting the shear tie 20 into the unhardened concrete and insulation panel. The base portion 21 of the anchor element 20 forms a closed top end wall 43*a* at the top opening 43 in the through-slot 40. In one embodiment, these end walls 43*a* may have an arcuately curved surface for more comfortable grasping of the anchor elements by an installer's fingers.

Shear ties 20 may be formed of a suitable thermally resistive material to minimize thermal bridging across the insulation panel between the interior and exterior wythes. In one non-limiting embodiment, the shear tie is made of glass fiber reinforced polymer (GFRP) such as without limitation pultruded thermoset polyester resin. GFRP has high strength, excellent insulating properties, ease of fabrication, and economic production. Furthermore, GFRP has a similar thermal expansion coefficient and Poisson ratio to concrete mitigating additional stresses from temperature changes and in directions other than the loading surface. Ranges of pertinent nominal properties for pultruded thermoset GFRP are shown in the table below:

| | |
|---|---|
| Nominal Density [lbf/cu.in.] | 0.069-0.076 |
| Tensile Strength [psi] | 40,000-100,000 |
| Compressive Strength [psi] | 35,000-68,000 |
| Flexural Strength [psi] | 45,000-105,000 |

Typical Poisson's ration is 0.12 for this GFRP material. In some embodiments, carbon, basalt or aramid fiber may be used in the FRP matrix in lieu of glass, but has a higher associated cost. Young's modulus for this assortment of fibers usable in the fiber reinforced polymer matrix is approximately 240 GPa for carbon fibers, 90 GPa for basalt fibers, 150 Gpa for aramid fibers, and 80 GPa for glass fibers. It will be appreciated that other suitable thermally resistive non-metallic materials of sufficient strength which exhibit ductile and elastic-plastic behavior to an applied load (for reasons further explained below) may be used.

FIGS. 5-8 show shear ties 20 installed in an insulated composite structural panel, which may be a composite structural wall panel 50 in one embodiment. The structural panel comprises a rigid first structural layer 51, a rigid second structural layer 52, and an intermediate insulation layer 53 disposed between the first and second layers. Structural layers 51 and 52 may be exterior or interior wythes (defined by the placement and orientation when the structural wall panel is mounted on a building superstructure). Structural layers 51, 52 have thicknesses TW1 and TW2 respectively. The structural layers 51, 52 can be any cast rigid structural material now known or to be developed which is poured in a viscous state, and subsequently cures and hardens to attain its strength. In the exemplary embodiment described herein, the structural layers 51, 52 may be formed of concrete. Any type or mixture of concrete suitable for forming structural wall panels may be used.

Insulation layer 53 has a thickness TI. Insulation layer 53 may be formed a suitable thermally resistive material, preferably having a self-supporting structure such as insulation board for ease of placement and fabrication of the structural panel 50. In other embodiments, the layer of insulation may be formed by a flowable and hardenable insulation material (e.g. foam insulation, etc.) which is formed and cast on top of the first structural layer 51. The invention is not limited by the type or manner of deposition of the insulation layer. An air gap can be used in place of a hardenable insulation material in other possible constructions. Preferably, the insulating material should be at least partially compressible and less dense than the shear tie material to allow the anchor elements 30, 31 of an installed shear tie 20 to deform within the insulation layer 53. In one non-limiting example, the insulation layer 53 may be made of an extruded polystyrene (XPS) board or panel. Other suitable insulating materials may be used, such as without limitation polystyrene foam, polyurethane foam, polypropylene foam, and others. Interfaces 56 and 5 are formed between the less rigid (softer) insulation layer 53 and the more rigid first and second structural layers 51, 52 respectively.

The composite structural panel 50 may have any dimensions. In one non-limiting example, structural layers 51 and 52 may have thicknesses TW1 and TW2 respectively of about 3 inches. The insulation layer 53 may have a thickness TI of about 2 inches. Other thicknesses of structural and insulating materials may be used. The panel 50 may have any appropriate width and length typically used for insulated composite structural wall panels formed of poured hardenable materials such as concrete.

With continuing reference to FIGS. 5-8, a shear tie 20 is shown embedded in the composite structural panel 50. Base portion 21 of the shear tie is shown positioned in structural layer 52 spaced apart from the exposed outer surface 54 of the layer. Structural layer 52 may be the interior layer or wythe in composite structural wall panel 50. The base portion 21 of shear tie 20 is arranged substantially parallel to outer surface 54 accounting for small variances in the installation orientation of the anchor by the composite wall panel fabricator. The laterally enlarged upper portions 36 of the anchor elements 30, 31 are also disposed in structural layer 52 such that top portion 41 of the through-slots 40 (containing top opening 43) is positioned in layer 52 outside of the insulation layer 53. This allows the structural material in structural layer 52 to flow through the top portions 41 of the through-slots for interlocking the shear tie 20 in this layer. The intermediate portions 35 and lower portions 39 of the anchor elements 30, 31 having parallel lateral sides 32 extend from the base portion 21 and pass completely through the insulation layer 53 and into the opposing structural layer 51. Structural layer 51 may be the exterior layer or wythe in composite structural wall panel 50. The distal ends 37 of the anchor elements are embedded in exterior structural layer 51 to a depth such that the pointed ends are spaced apart from the exposed outer surface 55 of the layer. The intermediate portions 35 of the anchor elements 30, 31 are positioned within the insulation layer 53.

Figure 6:
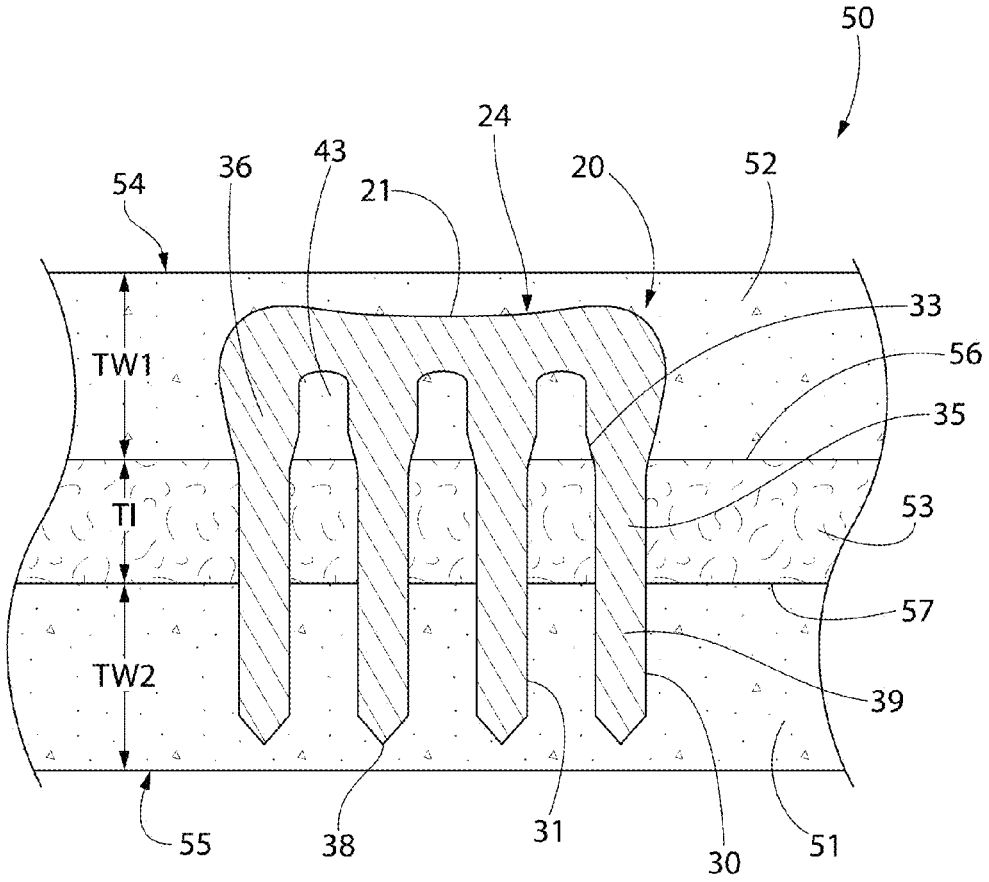
FIG. 6 is cross-sectional view of the shear tie installed in the composite structural wall panel.

Referring particularly to FIG. 6 now, it should be noted that only compressible insulating material is present between the intermediate portions 35 of the anchor elements 30, 31 in each shear tie 20 when the tie is pushed through the insulation layer 53 during installation. The insulation fills the through-slots 40 between the anchor elements. This softer material allows the intentional deformable portions of the anchor elements 30, 31 to flex and deflect/deform in a ductile manner to compensate for a transverse shift in position of structural layers 51 and/or 52 due to an out-of-plane load on the wall panel 50, as further described herein. Placing a rigid material or webs in the shear tie between the anchor elements would adversely inhibit the ability of the anchor elements to move and deform in the insulation layer 53 as desired.

Figure 7:
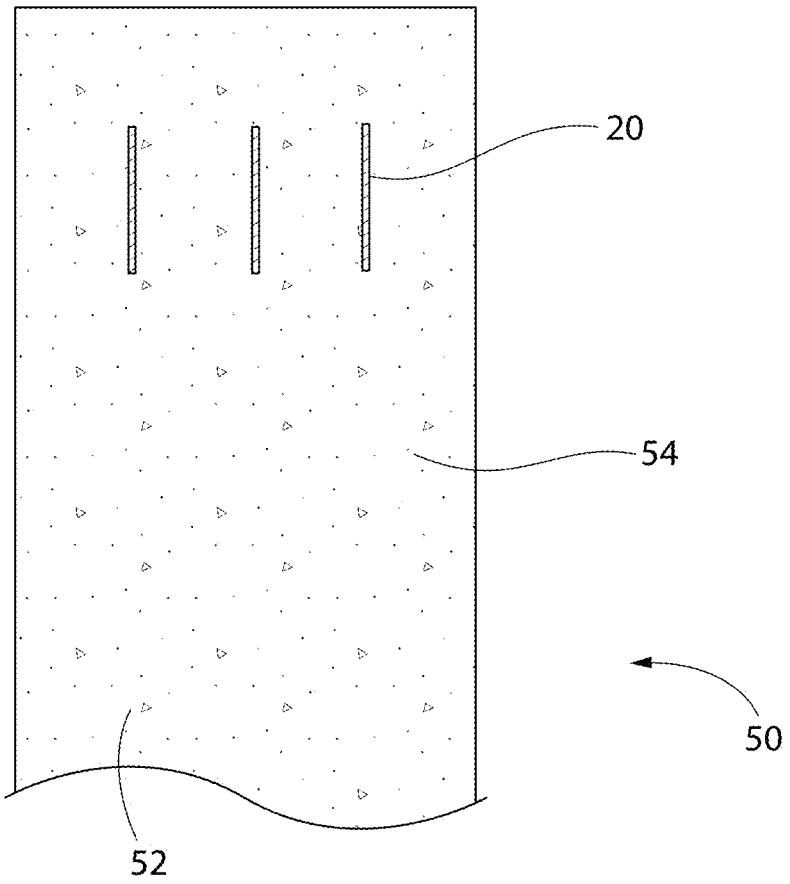
FIG. 7 is a side cross-sectional view of a portion of the structural wall panel showing an exemplary arrangement of shear ties.
Figure 8:
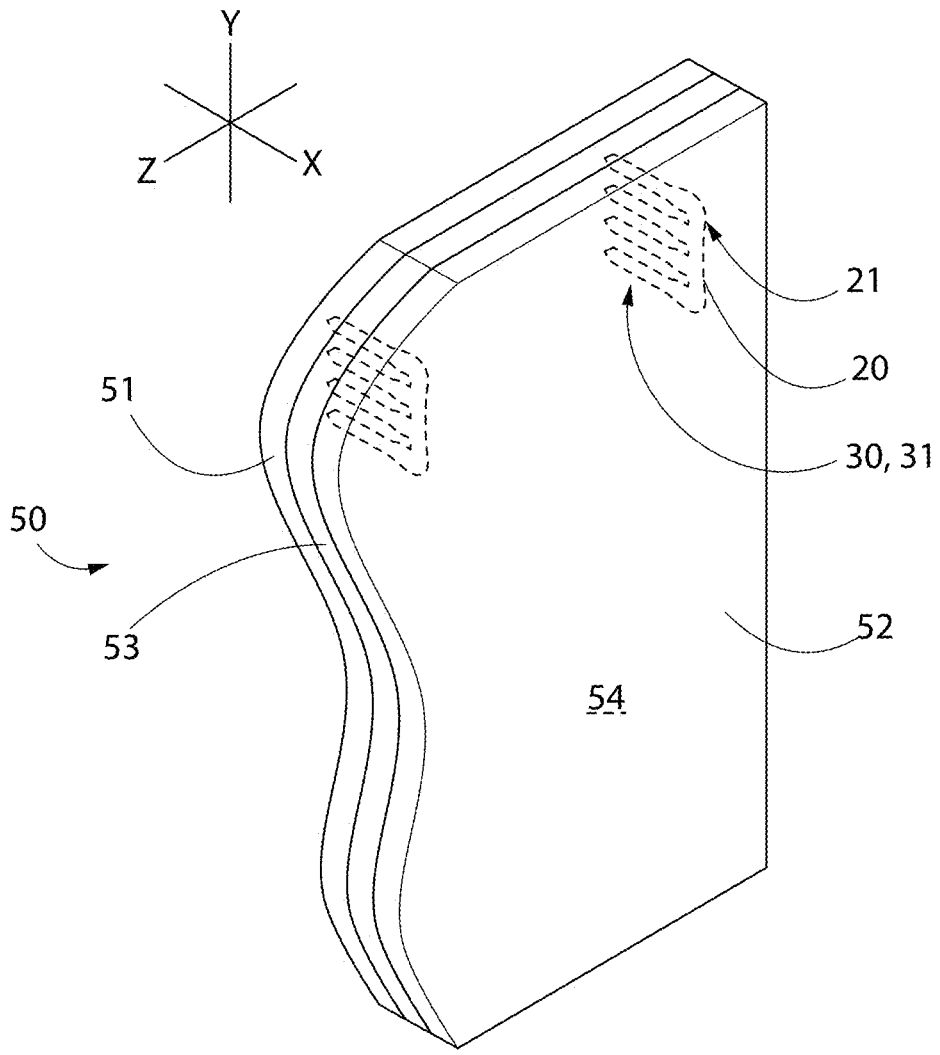
FIG. 8 is a perspective view thereof.

FIGS. 7 and 8 show one possible arrangement of shear ties 20 in a composite structural panel 50. An X-Y-Z Cartesian coordinate system is shown for reference. The anchor elements 30, 31 of the shear ties 20 extend in the Z-direction perpendicular to the X-Y plane corresponding to the exterior surface 54 of structural layer 52 (and the exterior surface 55 not visible of structural layer 51). The shear ties 20 may be positioned proximate to the ends of the panel. In one non-limiting example, six shear ties 20 may be provided on each of two ends of the panel for a panel approximately 20 feet long by 60 inches wide. Any appropriate number of shear ties and use of ties intermediate the ends of the panels may be used. The shear ties may be spaced to meet ACI 318-11 requirements (American Concrete Institute) for embedded anchors.

The shear tie 20 preferably is further constructed and formed of a material suitable to exhibit a ductile behavior or mechanism (i.e. elastic-plastic response) under an applied shear load (see, e.g. FIG. 9) preferably capable of large elastic deformations in structure and shape without failing. The shear tie 20 therefore preferably has an ability to deform in a ductile manner under shear load rather than fail in a brittle manner. The inventors have discovered that a shear tie with sufficient ductile and deformation capacity can better survive a shear loading event and keep the composite panel substantially intact by allowing the interior and exterior concrete wythes/layers to be laterally displaced or slip relative to each other and the wall panel (to a degree). This maintains sufficient stability of the composite wall structure for at least a period of time following a shear loading event until repairs may be enacted.

Accordingly, to provide the desired ductile behavior and deformation capacity, the shear tie in one non-limiting embodiment may be made of a GFRP material having a unidirectional glass fiber orientation running parallel to the anchor axes EA of the anchor elements 30, 31 (and longitudinal axis LA of the shear tie). The glass fibers therefore are arranged to extend along the length L1 of the anchor elements, rather than transversely. In alternative embodiments, unidirectional carbon or steel fibers may alternatively be used.

Figure 9:
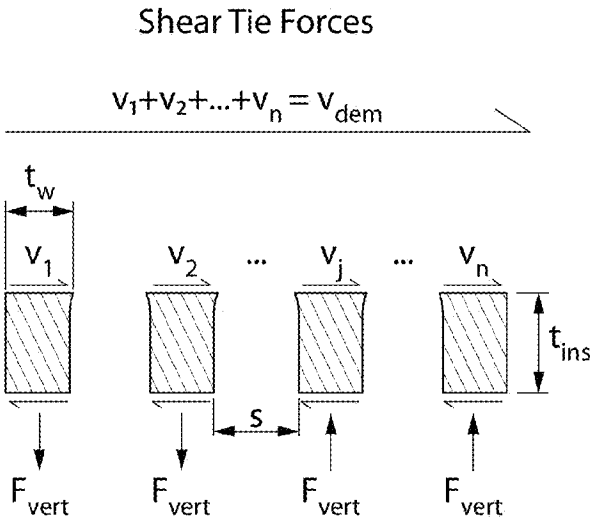
FIG. 9 is a cross-sectional view of the structural wall panel showing lateral translation of the interior and exterior concrete layers or wythes and corresponding shear forces developed in the shear tie.
Figure 9:
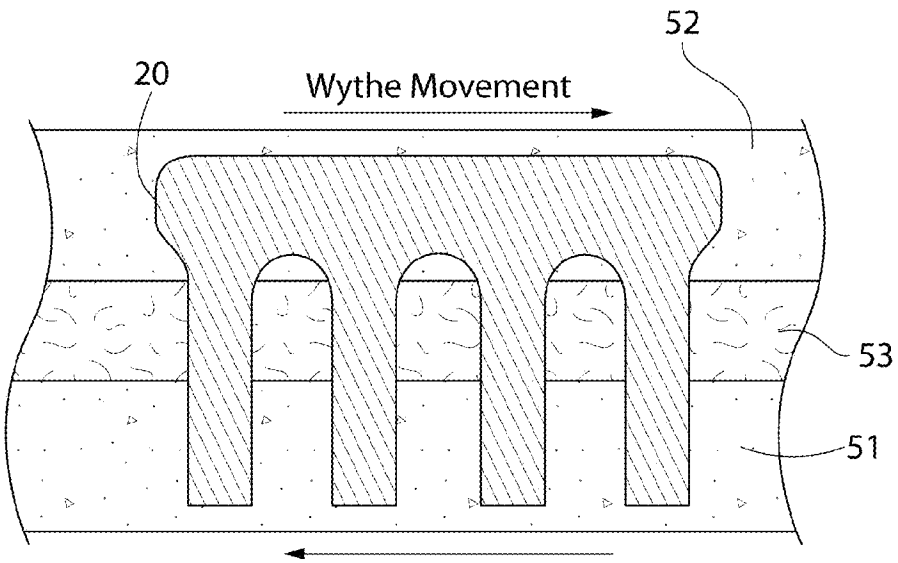
Figure 10:
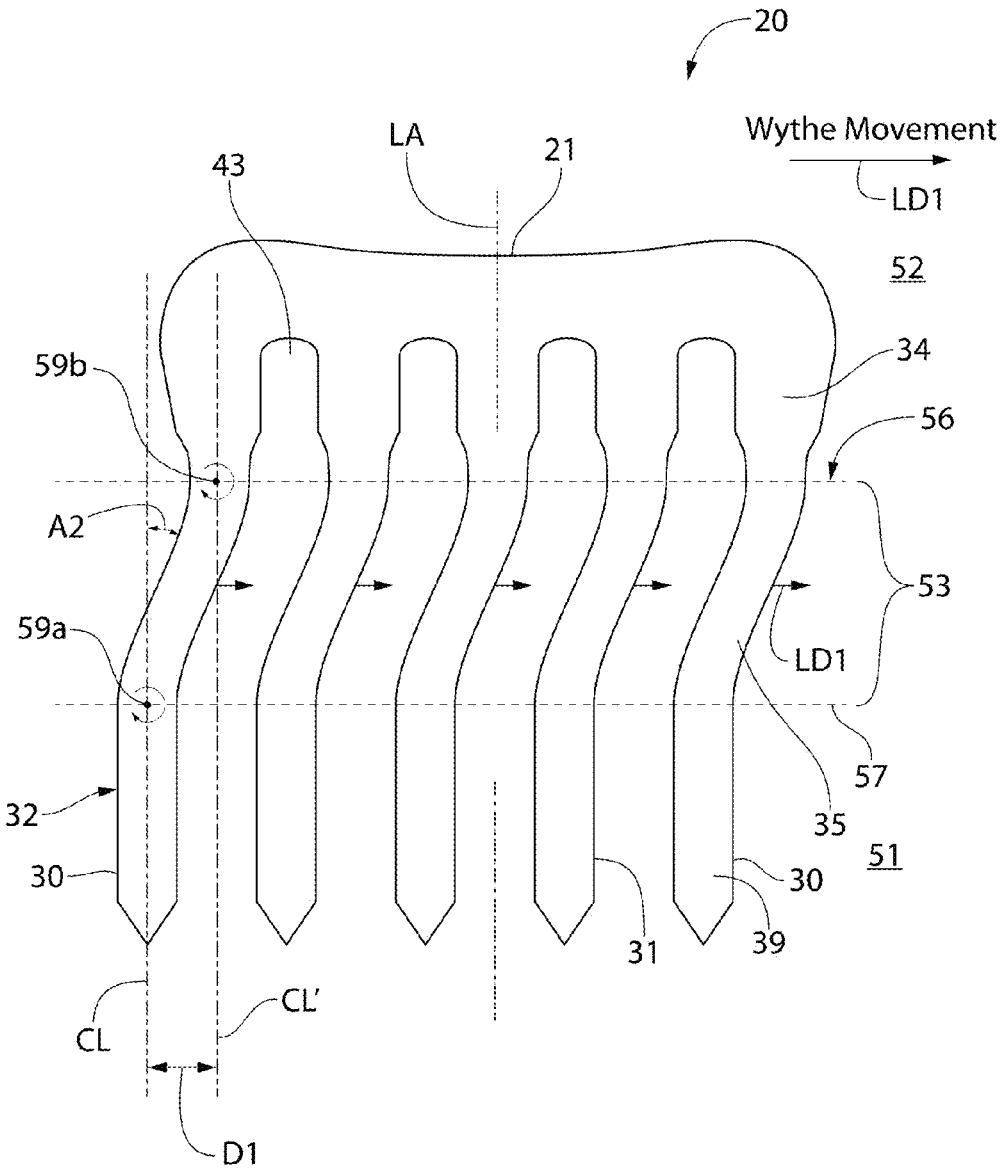
FIG. 10 is a side view showing the post-shear deformed condition of the shear tie exhibiting a plastic-elastic response to the imposed single shear load caused by a lateral concrete wythe or layer movement.
Figure 13:
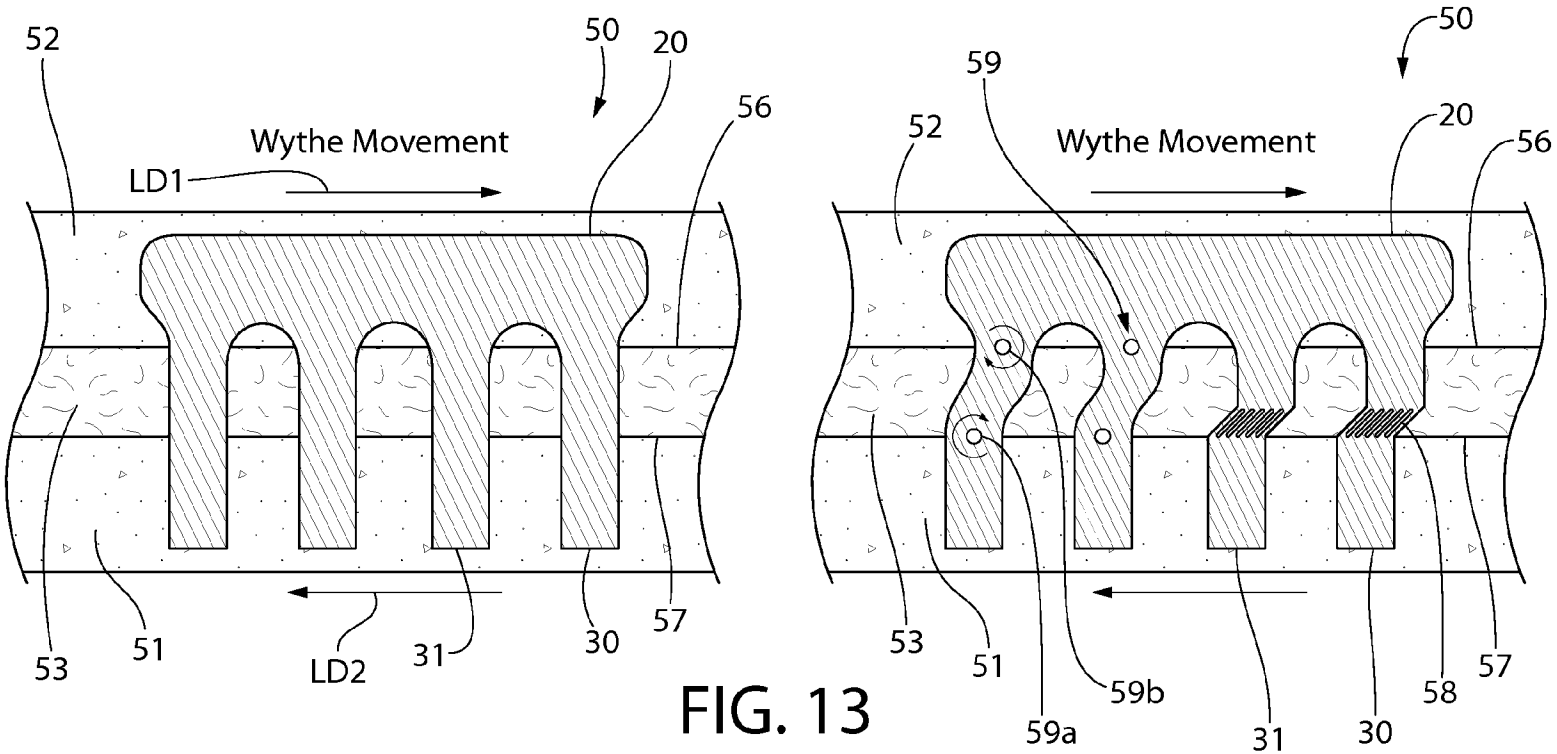
FIG. 13 shows the pre-shear undeformed condition/configuration of the shear tie (left) and the post-shear deformed condition/configuration of the shear tie after a double shear event resulting from movement of the concrete wythes or layers moving in opposite lateral directions.

The shear tie 20 is constructed to form stable ductile or flexural hinges 59 at the location where the anchor elements 30, 31 are embedded into each concrete wythe (layer) 51, 52 (see, e.g. FIGS. 10 and 13). Accordingly, a flexural hinge 59*a*, 59*b* is formed on each anchor element 30, 31 at the interfaces 56, 57 between structural layers 52, 51 respectively and the insulation layer 53. The flexural hinges 59 are graphically illustrated in location by imaginary circles (which do not represent actual physical structures in the anchor elements). The shear force Vj shown in FIG. 9 is provided by the ductile-action flexural hinges 59 formed by the unidirectional fiber reinforced polymer anchor elements 30, 31 in the present embodiment. In this unidirectional fiber construction, the fibers are arranged and run parallel to the length L1 of the anchor elements 30, 31. The flexural or ductile mechanism occurs as each anchor element 30, 31 undergoes flexure and the laminar shear strength is exceeded parallel to the fiber orientation. This unidirectional fiber laminar failure mode is seen in the photographic image of FIG. 11. As seen during failure, cracks begin to form in the resin-fiber matrix of each anchor element 30, 31 (i.e. intermediate portion 35 within insulation layer 53) thereby gradually allowing the fibers to delaminate from the matrix due to the unidirectional fiber flexural hinges 59. Advantageously, the portion of the anchor elements 30, 31 embedded in the softer insulation layer 53 (versus the concrete structural layers 51, 52) substantially deform and deflect laterally in an elastic-plastic manner in response to the applied shear load.

Figure 11:
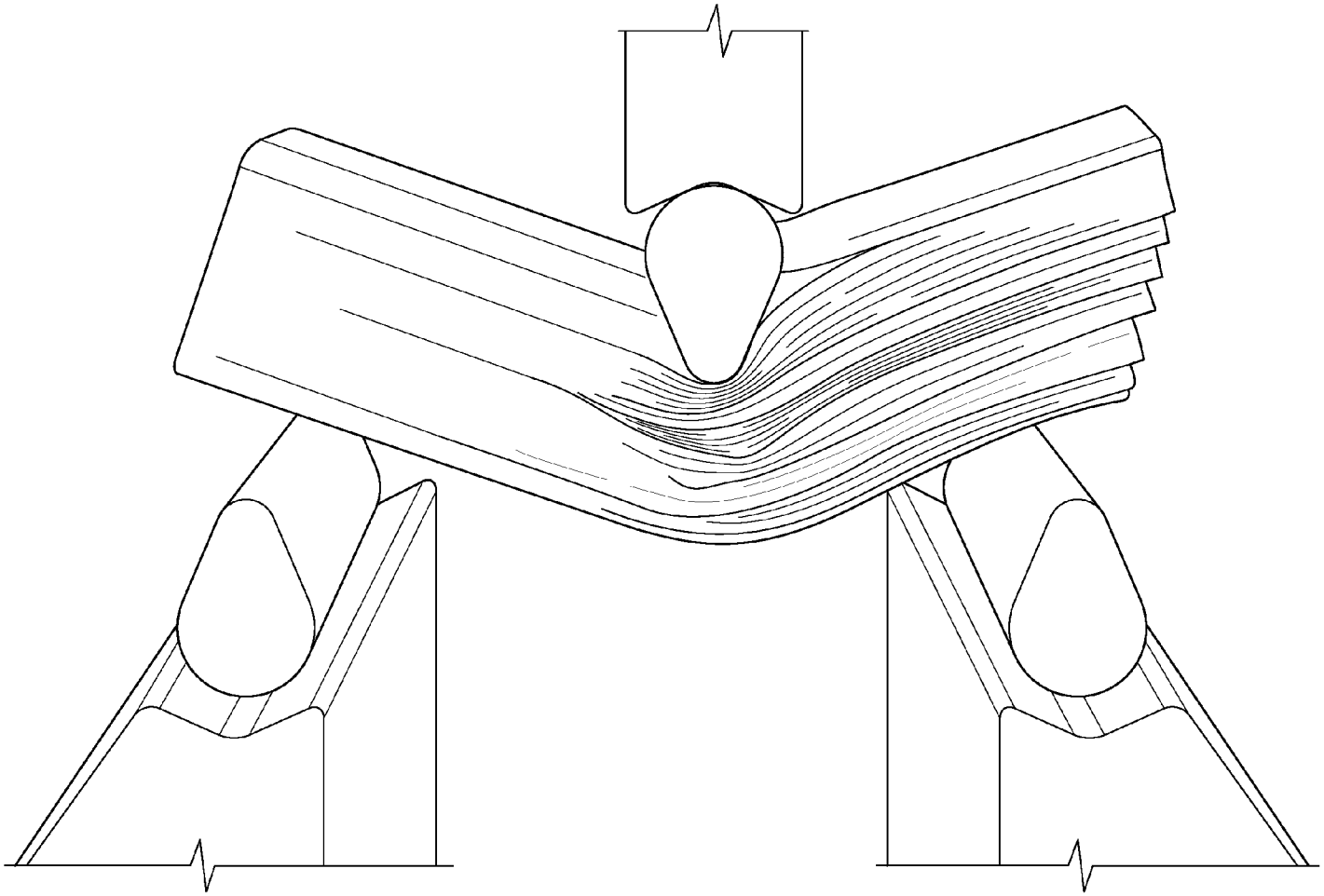
FIG. 11 is a graphic depiction of the results of load testing showing the elastic-plastic behavior of one construction of the shear tie formed of a unidirectional glass fiber reinforced polymer (GFRP) matrix under an applied shear load, the photograph showing the fibers delaminating from the polymer resin matrix and a ductile type failure mechanism.
Figure 12:
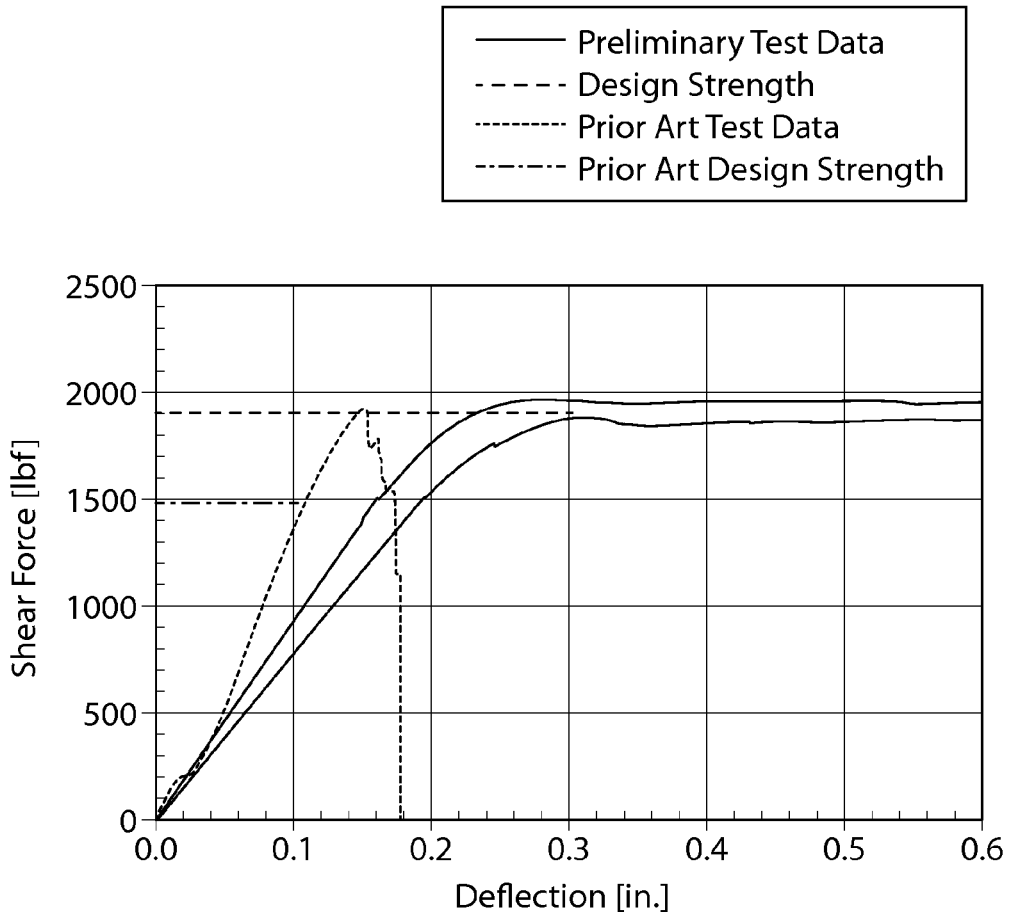
FIG. 12 is a shear force versus deflection (deformation) graph from shear load tests conducted for the unidirectional GFRP material using the testing apparatus seen in the photographic image of FIG. 11.

FIG. 12 is a shear force versus deflection (deformation) graph from shear load tests conducted for a unidirectional GFRP material using the testing apparatus seen in the image of FIG. 11. The test specimen represents a single anchor element 30 or 31 of a shear tie 20 according to the present disclosure. As shown in FIG. 12, the shear tie material exhibits an elastic-plastic response which is distinct from brittle behavior as is readily recognizable by one skilled in the art. Two Preliminary Test Data obtained are shown in the graph. The test specimen had a rectangular cross section measuring 1 in. by 0.5 in. thick. In this test, the specimen reached a stable shear force capacity between 1800-2000 lbf. and a deflection at mid-span of at least 0.6 inches without failure. Due to the stability of the failure the Design Strength is the average of the two tests as shown in the graph. Failure of the ductile unidirectional-fiber resin matrix as opposed to a brittle fiber matrix anchor element and corresponding brittle failure mode allows the shear tie 20 to reach larger deformations, thereby increasing the maximum obtainable global deflection of the composite structural panel 50. In the present invention, this occurs in the anchor elements 30, 31 within the insulation layer 53 to form the pair of flexural hinges 59 in each element. Prior art shear ties that utilize FRP materials can achieve similar force capacity but fail abruptly and provide minimal deflection due to the brittle nature of their design. Due to the brittle nature, prior art ties require a substantial reduction from the Prior Art Test Data maximum strength to the allowable Prior Art Design Strength to ensure that the failure load is not achieved. Due to the stable nature of the present embodiment disclosed herein, minimal reductions are needed between the tested strength and the design strength as shown in FIG. 12.

It should be noted the ductile or flexural hinge, however, can be formed through a number of possible mechanisms. One approach is through the use of unidirectional fiber reinforced polymers such as GFRP, as already described herein. Other options for the formation of a stable ductile hinge mechanism include but are not limited to: the use of a high ductility resin with random fibers, or through the use of geometric variations in the anchor element section where it enters each concrete structural layer 51, 52.

FIG. 14 shows an example of a geometric hinge feature 58 which increases the ability of the anchor elements 30, 31 to flex and deform at insulation interfaces 56, 57. Such features may be created by judiciously removing material from the cross-section of the anchor elements at the interfaces. This provided greater lateral flexibility in the intermediate portion 35 of the anchor elements 30, 31 within the insulation layer 53. In the illustrated example, an array of longitudinally-extending parallel through-slits is shown formed at interface 57 which would produce the resulting ductile mechanism and deformation of a flexural hinge desired. The slits maintain sufficient tensile strength in the anchor elements 30, 31 for lifting and handling a finished structural panel via lifting hardware mounted in the first or second structural layers 51 or 52, but weakens the anchor elements in the lateral/transverse direction to produce a ductile hinge action. Under an applied transverse shear load, the slits would laterally deform and collapse as the anchor elements 30, 31 bend at the flexural hinge 59 locations (see, e.g. FIG. 14). Similar flexural slits 58 may be formed at the top interface 56 on the anchor elements. Other configurations of geometric features such as other shaped apertures or holes, or reduced or narrowed lateral width of the anchor element cross-section at the interfaces 56, 57 may be used.

It bears noting that in some embodiments, a single flexural hinge 59*a* or 59*b* may achieve the desired ductile deformation/deflection of the anchor elements 30, 31. An example is seen in the portion of the shear ties in FIG. 14 (right image) showing the geometric hinge features 58 formed at the bottom insulation-to-structural layer interface 57. Accordingly, all embodiments according to the present disclosure do not necessarily require two flexural hinges 59 on each anchor element 30, 31 for certain applications and anticipated shear load conditions.

During fabrication, lifting hardware such as eyebolts are typically cast into the interior structural layer or wythe, which may be the top second and final structural layer 52 shown in FIG. 6 to be poured or cast in a typical panel fabrication method. The bottom first structural layer 51 in FIG. 6 is cast first to serve as the exterior layer or wythe. Once the concrete has cured and hardened, the panel is lifted at the installed lift points thus creating a tensile demand on the shear ties equal to the weight of the exterior structural layer or wythe 51 or 52. The number of interior anchor elements 31 of the shear ties 20 provided preferably should be sufficient to provide a tensile strength greater than the estimate tensile demand.

Finite element analysis was conducted to determine the stress contours in a shear tie 20 undergoing a single shear event (i.e. one structural layer 51 or 52 shifting or translating laterally). A Von Mises stress contour was generated for the shear tie from the analysis. The highest stress concentrations were at the interfaces 56, 57 of the insulation layer 53 and structural layers 51, 52. This would be the location for incipient failure of the shear tie 20 and coincides with the locations of the flexural hinges 59*a*, 59*b* formed in the intermediate portions 35 of the anchor elements 30, 31. Design and construction of the shear tie 20 including material selection therefore should be guided to produce the elastic-plastic behavior in the anchor elements 30, 31 in a manner capable of withstanding the estimated stresses at these high stress locations without brittle failure, thereby achieving the desired ductile deformation.

A process for sustaining a shear load in a composite structural panel and the resultant flexural or ductile action of the shear tie 20 according to the present invention will now be described with reference to FIGS. 10 and 13. FIG. 10 shows a single shear event in which the second structural layer 52 (e.g. concrete) moves laterally/transversely to the right (direction LD1). FIG. 13 shows a double shear event in which the second structural layer moves laterally/transverse to the right (direction LD1) and the first structural layer 51 moves laterally/transversely to the left (direction LD2) in an opposite direction. In either scenario, the response and performance of the shear ties and their respective anchor elements 30, 31 is similar.

The shear tie is formed of a material exhibiting an elastic-plastic behavior to a shear load, such as the unidirectional glass fiber reinforced polymer described herein in which the fibers run in a direction parallel to the length L1 of the anchor elements. The anchor elements 30, 31 in the insulation layer 53 are initially oriented parallel to the longitudinal axis LA of the shear tie 20 in the pre-shear undeformed condition shown in FIG. 6. The structural panel 50 may be considered mounted on a building superstructure and undergoes an out-of-plane loading event (e.g. wind load, percussive blast, etc.), thereby triggering a shear load or force event on the structural panel 50 and shear ties 20.

Referring still to FIGS. 10 and 13, an out-of-plane loading event occurs on the composite structural panel 50. This may cause the second structural layer 52 (single shear event, FIG. 10) or first and second structural layers 51, 52 (double shear event, FIG. 13) to shift or move laterally/transversely with respect to insulation layer 53. In this scenario, a single shear event will be assumed for simplicity in which only the second layer 52 (with base portion 21 embedded therein) is laterally moving in a first lateral direction LD1 (to the right) transverse to the longitudinal axis LA of the shear tie 20. This applies a shear load or force acting in the same direction onto to the intermediate portion 35 of each anchor element 30, 31 disposed in the insulation layer 53.

In response, the intermediate portion 35 of each anchor element 30,31 deflects or bends in the same first lateral direction LD1 in an elastic-plastic manner in response to moving the second structural layer 52. The graph shown in FIG. 12 discussed above shows the elastic-plastic response of the shear tie in the deformation zone (insulation layer) and ability to undergo a substantial lateral displacement and deflection via bending action without failure (e.g. at least 0.6 inches in the test case graph). The upper portion 34 of the anchor elements 30, 31 remain rigidly embedded in the second structural layer 52 and the lower portions 30 remain rigidly embedded in the first structural layer 51. The open through-slots 40 between the anchor elements 30, 31 provide maximum flexion of the intermediate portions 35 of the elements allowing them to shift in position and deform accordingly as needed without failure.

During deformation of the shear tie 20 above, the portion of the anchor element axial centerline associated with the upper portions 34 of the anchor elements shifts laterally in the first lateral direction LD1 to establish a new post-deformation centerline CL' position with respect to the original centerline CL represented by the lower portions 39 of the anchor elements embedded in the first structural layer 51 (which has not shifted laterally in this single shear example). The centerline CL' of the anchor element upper portions 34 have transversely shifted and been displaced by a lateral distance D1. Centerline CL' remains parallel to longitudinal axis LA of the shear tie 20 by virtue of the embedment of the upper portions in the second structural layer 52. The original centerline CL associated with the lower portions 39 of the anchor elements remains parallel to longitudinal axis LA as well.

The anchor element intermediate portions 35 and their respective lateral sides 32 have angularly deformed about the flexural hinges 59 resulting in their lateral displacement represented by distance D1. The intermediate portions 35 in the insulation layer 53 are now bent or slanted in the first lateral direction LD1 by an angle A2 with respect to the original centerline CL (parallel to longitudinal axis LA). This occurs as the upper section or half of the intermediate portion 35 of each anchor element 30, 31 (proximate to interface 56 between the second concrete layer 52 and the insulation layer 53) rotates clockwise about the top flexural hinge 59*b* (see rotational arrow). The lower section or half of the intermediate portion 35 of each anchor element 30, 31 in the insulation layer 53 (proximate to interface 57 between the first concrete layer 51 and the insulation layer) rotates clockwise about bottom flexural hinge 59*a* (see rotational arrow). The flexural hinges 59*a*, 59*b* act as pivot or rotation axes about which the anchor element intermediate portions 35 of the shear tie 20 angularly moves while undergoing deformation and deflection.

In the post-shear deformed condition or position shown in FIG. 10, the intermediate portions 35 of the anchor elements 30, 31 are now obliquely oriented at angle A2 to the original axial centerline of the anchor elements 30, 31 and longitudinal axis LA of the shear tie 20. In the pre-shear undeformed condition or position (see, e.g. FIG. 6), these intermediate portions were oriented parallel to the longitudinal axis LA.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. An insulated composite structural wall panel comprising:

a first concrete layer;

a second concrete layer;

an insulation layer disposed between the first and second concrete layers;

a shear tie embedded in the wall panel and connecting the first concrete layer to the second concrete layer, the shear tie having a longitudinal axis, a base portion, and a plurality of longitudinally elongated anchor elements extending therefrom, the shear tie constructed of a non-metallic material that exhibits an elastic-plastic response to an applied shear load;

each of the anchor elements having a length, an upper portion disposed in the first concrete layer, a lower portion defining a terminal distal end disposed in the second concrete layer, and an intermediate portion disposed in the insulation layer;

a first flexural hinge formed in each anchor element at a first interface between the first concrete layer and the insulation layer; and wherein when a transverse shear load is applied to the anchor elements by lateral movement of the first or second concrete layers, the intermediate portion of each anchor element is transversely and angularly deformed in an elastic-plastic manner about the first flexural hinge within the insulation layer.

2. The structural wall panel according to claim 1, wherein the shear tie is deformable from a pre-shear undeformed condition in which the intermediate portion of the anchor elements are oriented parallel to the longitudinal axis of shear tie, to a post-shear deformed condition in which the intermediate portion of the anchor elements is obliquely oriented the longitudinal axis of the shear tie.

3. The structural wall panel according to claim 1, wherein the shear tie is formed of a unidirectional fiber reinforced polymer matrix, the fibers in each anchor element running in a direction along the length of each anchor element.

4. The structural wall panel according to claim 3, wherein the fibers in the intermediate portion of the anchor elements are delaminated from the polymer matrix after the shear load is applied.

5. The structural wall panel according to claim 1, wherein the shear tie is formed of a ductile resin matrix with randomly oriented fibers having a ductile-elastic response to the shear load.

6. The structural wall panel according to claim 1, wherein the proximal end of each anchor element is laterally enlarged in relation to the intermediate portion of the anchor element.

7. The structural wall panel according to claim 1, wherein the terminal distal ends of the anchor elements are pointed.

8. The structural wall panel according to claim 1, further comprising elongated through-slots formed between the anchor elements, the through-slots longitudinally extending for the entire length of the anchor elements.

9. The structural wall panel according to claim 1, wherein the anchor elements have a rectilinear cross-sectional shape.

10. The structural wall panel according to claim 1, wherein the intermediate portion of each anchor element in the insulation layer has opposing lateral sides which are oriented parallel to each other.

11. The structural wall panel according to claim 1, further comprising a second flexural hinge formed in each anchor element at a second interface between the second concrete layer and the insulation layer, wherein each anchor element is transversely and angularly deformed in an elastic-plastic manner about the first and second flexural hinges within the insulation layer when a transverse shear load is applied to the anchor elements.

12. A method for fabricating the structural wall panel according to claim 1, the method comprising:

casting the first concrete layer, the first concrete layer being in an unhardened condition;

depositing the insulation layer on the first concrete layer;

inserting the anchor elements of the shear tie completely through the insulation layer and partially into the first concrete layer, wherein the base portion of the shear tie is exposed and positioned above the insulation layer; and casting the second concrete layer on the insulation layer to embed the base portion of the shear tie in the second concrete layer.

13. An insulated composite structural wall panel comprising:

a first concrete layer;

a second concrete layer;

an insulation layer disposed between the first and second concrete layers;

a shear tie comprising a longitudinal axis, a front surface having a flat profile, and a rear surface having a flat profile and parallel to the front surface, the shear tie formed of a fiber reinforced polymer material characterized by an elastic-plastic response to an applied shear load;

a base portion defined by the shear tie and extending transversely to the longitudinal axis;

a plurality of elongated anchor elements extending from the base portion parallel to the longitudinal axis, each anchor element having a rectilinear cross-section, a length, opposing lateral sides, a proximal end at the base portion, an opposite distal end, and an axial centerline, the anchor elements spaced laterally apart by elongated through-slots formed between the anchor elements that extend for the entire length of the anchor elements;

each of the anchor elements having a an upper portion embedded in the first concrete layer, a lower portion embedded in the second concrete layer, and an intermediate portion disposed in the insulation layer;

wherein after a transverse shear load is applied to the first or second concrete layer, the intermediate portion of each anchor element within the insulation layer is deformed in a ductile elastic-plastic manner and laterally displaced such that the axial centerlines of the upper and lower portions are laterally offset from each other;

wherein the fiber reinforced polymer comprises unidirectional fibers in each anchor element running in a direction parallel to the longitudinal axis along the length of each anchor element.

14. The structural wall panel according to claim 13, wherein the lateral sides of anchor elements are parallel in the insulation layer before to the shear load being applied.

15. The structural wall panel according to claim 14, wherein the lateral sides of the anchor elements are substantially parallel in the insulation layer after the shear load is applied.

16. The structural wall panel according to claim 13, further comprising longitudinally extending slots extending parallel to the longitudinal axis between each anchor element.

17. The structural wall panel according to claim 13, wherein the shear tie is deformable from a pre-shear undeformed condition in which the anchor elements are oriented parallel to the longitudinal axis within the insulation layer, to a post-shear deformed condition in which intermediate portions of the anchor elements are obliquely oriented to the longitudinal axis and lower portions are parallel to the longitudinal axis.

18. The structural wall panel according to claim 13, wherein the intermediate portions of each anchor element after the shear load is applied angularly deform about a flexural hinge formed at a first interface between the first concrete layer and the insulation layer and a flexural hinge formed at a second interface between the second concrete layer and the insulation layer.

19. The structural wall panel according to claim 13, wherein the lateral sides of each anchor element in the insulation layer are oriented parallel to each other.

20. A method for sustaining an applied shear force in a composite structural panel, the method comprising:

providing the composite structural panel including a first concrete layer, a second concrete layer, and an insulation layer disposed therebetween;

providing a shear tie connecting the first concrete layer to the second concrete layer, the shear tie having a longitudinal axis, a base portion embedded in the first concrete layer, and a plurality of longitudinally elongated anchor elements connected to the base portion, each anchor element having an upper portion embedded in the second concrete layer, a lower portion defining a terminal distal end embedded in the first concrete layer, and an intermediate portion disposed in the insulation layer and oriented parallel to the longitudinal axis of the shear tie;

the anchor elements of the shear tie constructed of a non-metallic material that exhibits an elastic-plastic response and failure mode to an applied shear load;

laterally translating the first or second concrete layer in a first lateral direction transverse to the longitudinal axis of the shear tie, wherein a shear load is applied to the intermediate portion of each anchor element;

deforming the intermediate portion of each anchor element in an elastic-plastic manner in response to translating the first or second concrete layer; and laterally deflecting the intermediate portion of each anchor element in the first lateral direction;

wherein the intermediate portions of each anchor element in the insulation layer are oriented obliquely to the longitudinal axis of the shear tie;

wherein the anchor elements of the shear tie are formed of a unidirectional fiber reinforced polymer matrix, the fibers in each anchor element running in a direction along a length of each anchor element.

* * * * *